US008100174B2

(12) United States Patent
Halse

(10) Patent No.: US 8,100,174 B2
(45) Date of Patent: Jan. 24, 2012

(54) DRILL FLUID COLLECTING DEVICE AND METHOD OF USE

(75) Inventor: Helge-Ruben Halse, Kristiansand (NO)

(73) Assignee: Weatherford Rig Systems AS, Kristiansand S (NO)

( * ) Notice: Subject to any disclaimer, the term of this patent is extended or adjusted under 35 U.S.C. 154(b) by 321 days.

(21) Appl. No.: 12/095,707

(22) PCT Filed: Nov. 29, 2006

(86) PCT No.: PCT/NO2006/000437

§ 371 (c)(1),
(2), (4) Date: Jul. 31, 2008

(87) PCT Pub. No.: WO2007/064218

PCT Pub. Date: Jun. 7, 2007

(65) Prior Publication Data

US 2010/0218934 A1 Sep. 2, 2010

(30) Foreign Application Priority Data

Dec. 1, 2005 (NO) ..... 20055675

(51) Int. Cl.
*E21B 19/16* (2006.01)

(52) U.S. Cl. ..... 166/81.1; 166/77.51

(58) Field of Classification Search ..... 166/81.1, 166/77.51; 81/57.19, 57.21, 57.34
See application file for complete search history.

(56) References Cited

U.S. PATENT DOCUMENTS

| | | | |
|---|---|---|---|
| 4,391,376 | A | 7/1983 | Finnegan |
| 4,643,259 | A | 2/1987 | Zeringue, Jr. |
| 5,295,536 | A | 3/1994 | Bode |

FOREIGN PATENT DOCUMENTS

| | | | |
|---|---|---|---|
| GB | 2300659 | A | 11/1996 |
| GB | 2348446 | A | 10/2000 |
| WO | WO-00/23686 | | 4/2000 |
| WO | WO-01/49968 | | 7/2001 |
| WO | WO-01/51763 | A1 | 7/2001 |
| WO | WO-2005/073499 | | 8/2005 |

OTHER PUBLICATIONS

International Search Report dated Apr. 22, 2005, International Application No. PCT/NO2005/000003.

*Primary Examiner* — David Andrews
(74) *Attorney, Agent, or Firm* — Patterson & Sheridan, L.L.P.

(57) ABSTRACT

A drill fluid collecting device, in which a space between a power tong (2) and a backup tong (4) is provided with collecting means, and in which, on their respective sides facing the space, the power tong (2) and the backup tong (4) are provided with a seal (56, 62) which is sealingly movable against a pipe (20, 22) located in the tongs and sealingly connected to its respective tong (2, 4).

21 Claims, 4 Drawing Sheets

I-I

DRILL FLUID COLLECTING DEVICE AND METHOD OF USE

This invention relates to a drill fluid collecting device. More particularly, it relates to a collecting device, in which a first seal and a second seal are sealingly movable against a pipe located in the tongs. The seals together with at least a shield form a collecting space. It is advantageous that a power tong and a backup tong cooperating with the power tong are provided with scrapers, the scrapers being arranged to surround the pipe string in a sealing manner. Thus, drill fluid flowing out of a pipe length as the pipe length is disconnected from the pipe string by means of the tongs, flows into a closed collecting space between the tongs and may then be transported away from the collecting space.

When drilling in the ground, as it is known for example from the recovery of petroleum, it is common to pump drill fluid down to the drilling tool through a pipe string. A pipe string of this kind, which may be a drill string, includes a plurality of interconnected pipe lengths. The pipe lengths are typically interconnected by means of threaded sleeve portions.

When a pipe string, typically a drill string, is to be tripped out of the borehole, for example, for maintenance work to be carried out on the drilling tool, the drill string has to be divided into suitable lengths for intermediate storing. It is common to use a power tong to break out a pipe length from the drill string, whereas a backup tong prevents the drill string from rotating. This method is well known to a person skilled in the art and will therefore not be described in further detail.

Drill fluid present in the pipe length which is being disconnected from the drill string, will flow, as the pipe length is disconnected from the pipe string, out of the pipe length in the area between the power tong and the backup tong.

It is desirable, for several reasons, to collect the out-flowing drill fluid. If allowed to flow freely, the drill fluid will soil and pollute both drilling equipment and the environment in which the drilling takes place. Besides, the drill fluid contains valuable materials that should be taken care of.

From U.S. Pat. No. 4,643,259 it is known to place collecting devices at a power tong. This document describes a mounting of a power tong and a backup tong, in which there is arranged a collecting device for collecting drill fluid during the disconnection of pipe segments.

However, prior art collecting devices are not sufficiently tight, thereby allowing an unacceptable, great portion of the drill fluid to leak out during the disconnecting work.

The invention has as its object to remedy or reduce at least one of the drawbacks of the prior art.

The object is achieved according to the invention through the features specified in the description below and in the Claims that follow.

In a drill fluid collecting device according to the invention, in which, in a space between a power tong and a backup tong, there are arranged collecting means, a first seal and a second seal are sealingly movable against a pipe located in the tongs. The seals together with at least a shield form a collecting space.

It is advantageous that, on their respective sides facing the space, the power tong and the backup tong are provided with a seal which is sealingly movable against a pipe located in the tongs.

The seal may, with advantage, be formed as an annular gland plate, such as a one-piece annular seal.

The tongs in question normally include at least two clamp groups and the seal is typically clamped to its respective clamp group by means of semicircular plate portions and clamping hooks to its respective tong.

If it becomes necessary to remove the clamp groups from the tongs while a pipe, extending therethrough, is still in the tongs, the seal may be cut or divided in some other way.

Thus, it is relatively easy to replace a worn or damaged seal. The clamps are rotated out from the plate portions, after which the seal and plate portion are removed. A new seal is fitted correspondingly in a reverse order.

The seal is connected to the respective clamp groups of the tongs. In the device of this application the clamps of the tongs may move freely between their free retracted position and their advanced position gripping the pipe while protected by the seal.

A volume defined by the power tong with its first seal, the backup tong with its second seal and a shield between the power tong and the backup tong is arranged to form a sealed collecting space for drill fluid or some other fluid and communicates with a fluid collecting device.

In what follows there is described a non-limiting example of a preferred embodiment which is visualized in the accompanying drawings, in which.

Figure 1:
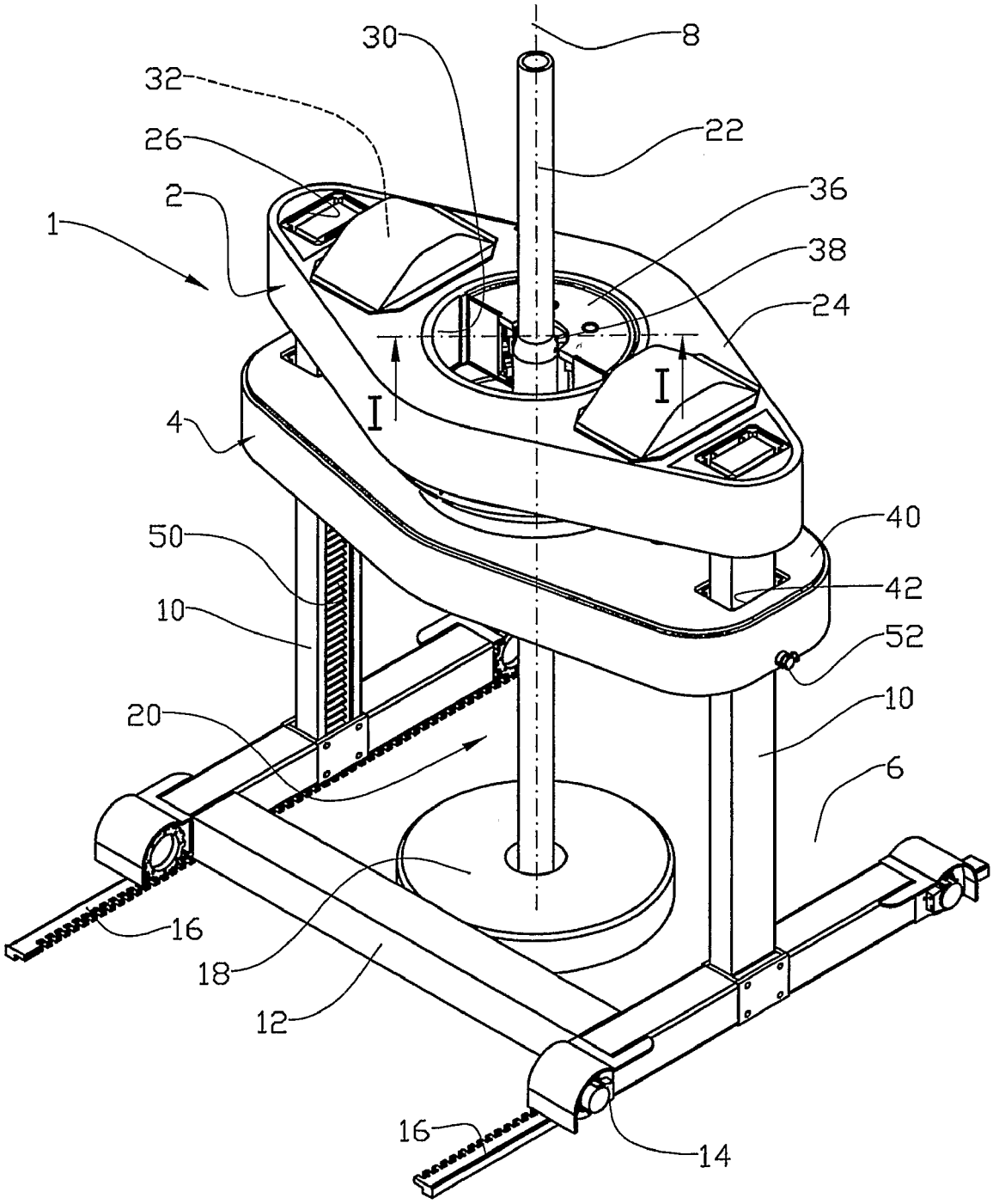
FIG. 1 shows in perspective an assembly of a power tong, in which a clamp group has been removed for reasons of illustration, and a backup tong on a horizontally movable chassis, the assembly having been moved to its upper position.

In the drawings the reference numeral 1 denotes an assembly of a power tong 2 and a backup tong 4 located on a drilling rig 6 coaxially to the drilling centre 8 of the drilling rig 6. Vertically movable, the assembly 1 is connected to two, relative to the drilling centre 8, diametrically opposite guide columns 10.

The guide columns 10 are connected to a chassis 12 which is horizontally movable, by means of wheels 14 and hydraulic motors not shown, on rails 16 connected to the drilling rig 6.

In its operative position the assembly 1 is thus just above the slips 18 of the drilling rig 6, a pipe string 20 projecting through the slips 18 and further up through the assembly 1. The pipe string 20 is formed by pipe lengths 22 screwed together.

The power tong 2 includes a power tong housing 24 which is provided with a through guide 26 corresponding to the guide columns 10, and an undivided drive ring 30 supported on the power tong housing 24 by means of a bearing 28.

The drive ring 30 is rotated about the drilling centre 8 by means of two hydraulic motors 32.

In the drive ring 30 and co-rotating therewith are arranged two crescent-shaped clamp groups 36, only one of them being shown in the drawings for reasons of illustration.

Either clamp group 36 is typically provided with three hydraulically movable first clamps 38 distributed round the well centre 8.

Figure 2:
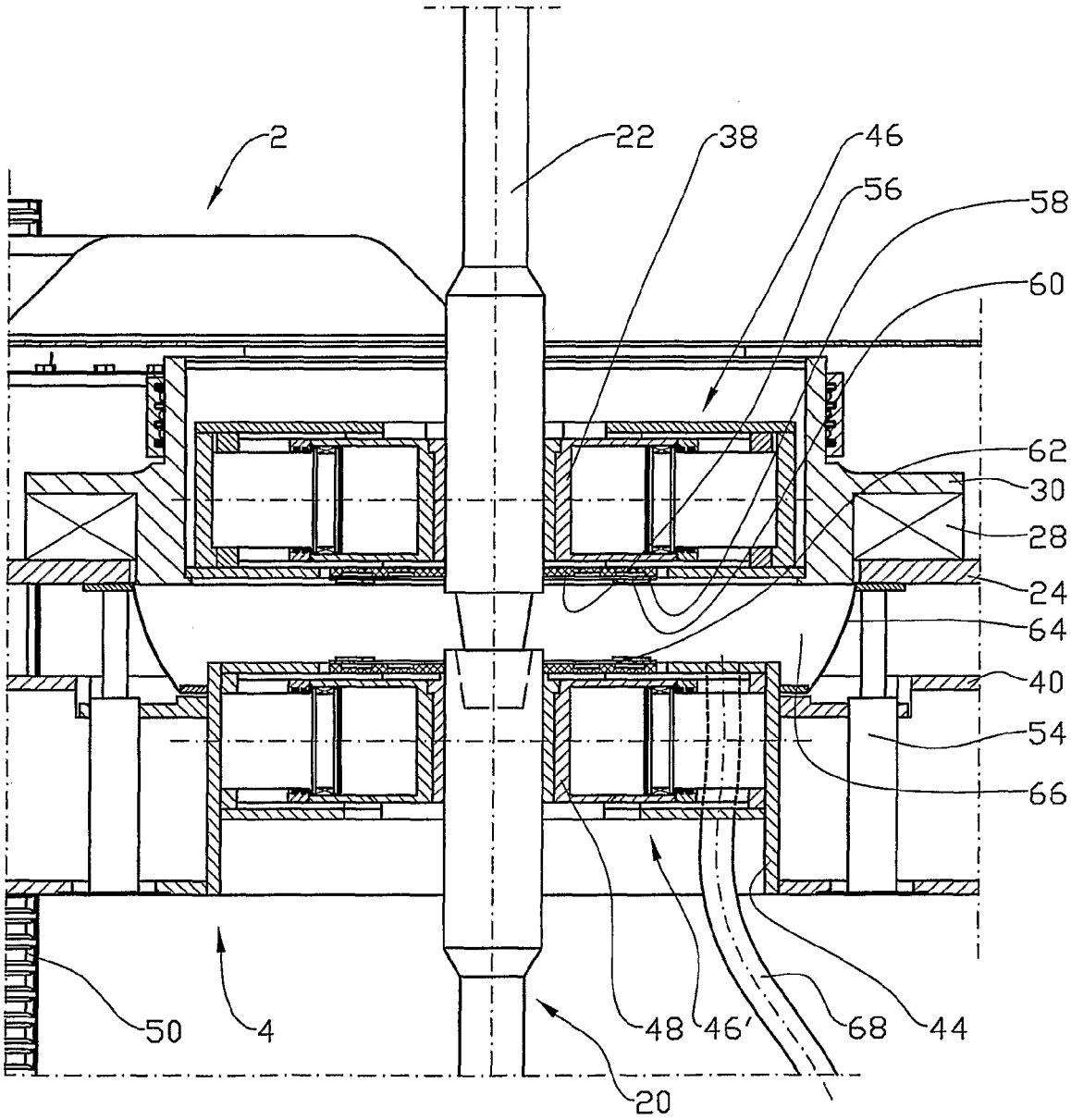
FIG. 2 shows, on a larger scale, a section I-I of FIG. 1.
Figure 3:
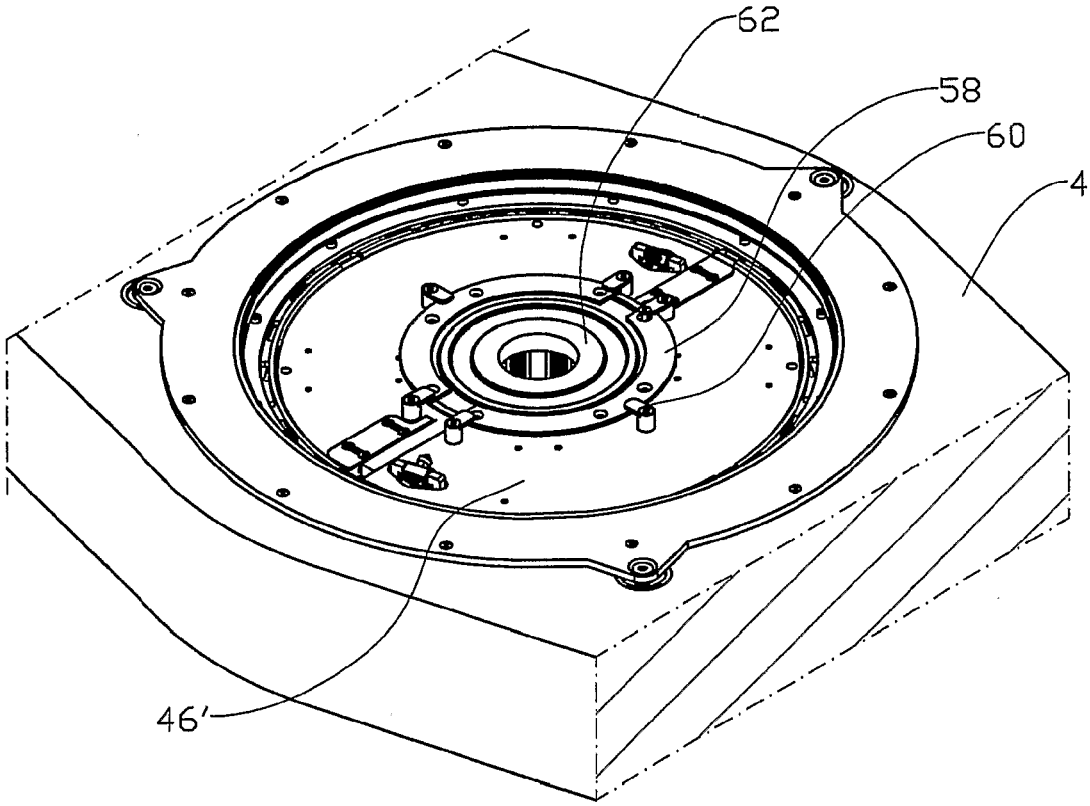
FIG. 3 shows a section of the backup tong with the second seal.
Figure 4:
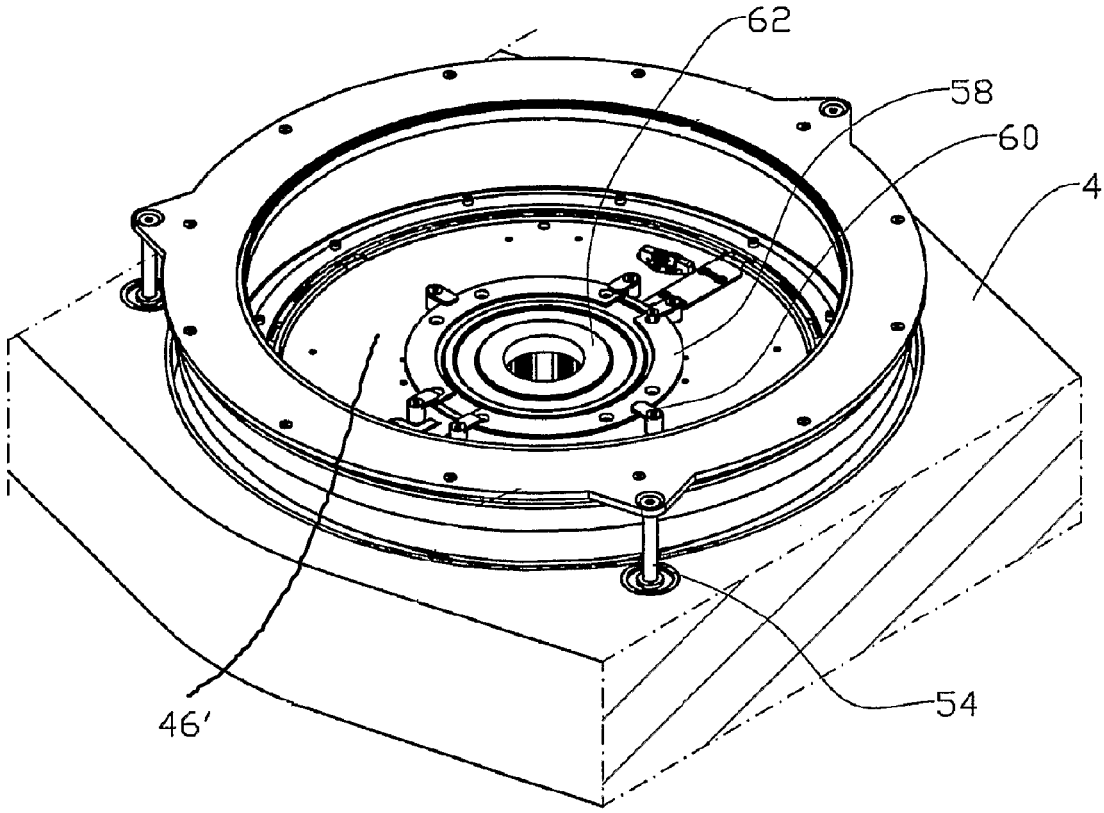
FIG. 4 shows the same as FIG. 3, but here the shield has been lifted to its upper position.

The backup tong 4 includes a backup tong housing 40 with guides 42 corresponding to the guide columns 10, and a supporting ring 44, see FIG. 2, for two clamp groups 46', either one including three other clamps 48.

At the guides 42 there are arranged cogwheels, not shown, in mesh with the respective pitch racks 50 of the guide columns 10.

The cogwheels not shown are driven by a hydraulic motor each, by way of gears not shown. The guide columns 10 can be locked into the backup tong housing 40 by means of corresponding locking mandrels 52 movable in the backup tong housing 40.

A pair of hydraulic cylinders 54 directed upwards is arranged in the backup tong 4.

A first seal 56 is connected, surrounding the pipe length 22, to the clamp groups 46 of the power tong 2. The first seal 56 is clamped against the clamp groups 46 by means of a semi-circular plate portion 58 and L-shaped rotatable clamping hooks 60.

The clamping hooks 60 are rotated out of their operative position when the first seal is to be replaced.

Correspondingly, the clamp groups 46' of the backup tong 4 are provided with a second seal 62.

Surrounding the pipe string 20, a shield 64 in the form of a sealing bellows is arranged between the power tong 2 and the backup tong 4, see FIG. 2. The shield 64 is connected at its lower portion to the backup tong housing 40. The upper portion of the shield 64 is vertically movable by means of the cylinders 54. A collecting space 66 is thus defined by the power tong 2 including its first seal 56 and the backup tong 4 including its second seal 62 when the cylinders 54 tighten the shield against the power tong housing 24. Fluid flowing into the collecting space 66 is drained to a fluid-receiving unit, not shown, via a drain 68. The first seal 56 and a second seal 62, together with at least the shield 64, form the collecting space 66.

When a pipe length 22 is to be disconnected from the pipe string 20, the assembly 1 is moved vertically on the guide columns 10 by means of the hydraulic motors, gears, cog-wheels, not shown, and the pitch racks 48 until the backup tong 4 corresponds, in a known manner, to the upper sleeve portion of the pipe string 20. The vertical distance between the backup tong 4 and power tong 2 is adjusted in such a way that the clamp groups 36 correspond to the lower sleeve portion of the pipe length 22.

The first and second clamps 38, 48 are moved towards the pipe string 20 by means of pressure fluid and grip their respective pipe portions while, at the same time, the seals 56 and 62 seal against the pipe length 22 and pipe string 20, respectively. The motors 32 rotate the drive ring 30 and the first clamps 38 about the drilling centre 8 while, at the same time, the pipe string 20 is prevented from rotating by the second clamps 48.

As the pipe length 22 is broken out and disconnected from the pipe string 20, see FIG. 2, the drill fluid present in the pipe length 22 flows into the collecting space 66 and on via the drain 68 to a fluid-receiving unit not shown.

The invention claimed is:

1. A drill fluid collecting assembly for use between a power tong and a backup tong, the drill fluid collecting assembly comprising:

a shield disposed between the power tong and the backup tong;

a first seal assembly on the power tong; and a second seal assembly on the backup tong, each seal assembly including a one-piece annular seal and a plate member, wherein the one-piece annular seal is disposed between the plate member and a clamp group of the respective tong and the one-piece annular seal is clamped against the clamp group of the respective tong by the plate member and one or more clamp hooks.

2. The drill fluid collecting assembly of claim 1, wherein each seal assembly further includes at least one clamp hook configured to secure the plate member and the annular seal to the clamp group of the respective tong.

3. The drill fluid collecting assembly of claim 2, wherein the at least one clamp hook is movable between a release position and a clamp position.

4. The drill fluid collecting assembly of claim 3, wherein the plate member and the annular seal may be removed from the clamp group of the respective tong when the at least one clamp hook is in the release position.

5. The drill fluid collecting assembly of claim 2, wherein the at least one clamp hook is L-shaped and rotatable between a release position and a clamp position.

6. The drill fluid collecting assembly of claim 1, wherein an upper portion of the shield is movable relative to the power tong by a plurality of cylinders attached to the backup tong.

7. The drill fluid collecting assembly of claim 1, further including a drain for transporting fluid from the space between the power tong and the backup tong.

8. The drill fluid collecting assembly of claim 1, wherein the first seal assembly creating a seal between a first portion of a tubular string and the power tong.

9. The drill fluid collecting assembly of claim 8, wherein the second seal assembly creating a seal between a second portion of the tubular string and the backup tong.

10. The drill fluid collecting assembly of claim 1, wherein the first seal assembly is disposed on a lower portion of the power tong and the second seal assembly is disposed on an upper portion of the backup tong.

11. A method of collecting fluid between a power tong and a backup tong, the method comprising:

attaching a shield between the power tong and the backup tong;

creating a seal between a first portion of a tubular string and the power tong using a first one-piece annular seal that is clamped between a first plate and the power tong by one or more hook clamps;

creating a seal between a second portion of the tubular string and the backup tong using a second one-piece annular seal that is clamped between a second plate and the backup tong by one or more hook clamps; and collecting fluid in a space between the power tong and the backup tong.

12. The method of claim 11, further comprising transporting fluid from the space between the power tong and the backup tong to a fluid receiving unit.

13. The method of claim 11, wherein each annular seal is attached to a clamp group of the respective tong by a plate and a clamp member.

14. The method of claim 13, wherein the clamp member is rotatable between a release position and a clamp position.

15. A drill fluid collecting assembly for use between a power tong and a backup tong, the drill fluid collecting assembly comprising:

a shield disposed between the power tong and the backup tong;

a first one-piece annular seal having a first side in contact with a clamp group of the power tong and a second side in contact with a first clamp plate member, wherein the first one-piece annular seal is clamped against the power tong by the first clamp plate and one or more hook clamps; and a second one-piece annular seal having a first side in contact with a clamp group of the backup tong and a second side in contact with a second clamp plate member, wherein the second one-piece annular seal is clamped against the backup tong by the second clamp plate and one or more hook clamps.

16. The drill fluid collecting assembly of claim 15, wherein at least one hook clamp is used to attach the annular seal and clamp plate to the clamp group of the respective tong.

17. The drill fluid collecting assembly of claim 16, wherein the at least one hook clamp is rotatable between a release position and a clamp position.

18. A drill fluid collecting assembly for use between a power tong and a backup tong, each tong having a clamp group and a clamp member, the drill fluid collecting assembly comprising:

a shield disposed between the power tong and the backup tong;

a first seal assembly on the power tong; and a second seal assembly on the backup tong, each seal assembly including an annular seal that is clamped against the clamp group of the respective tong by a plate member and one or more clamp hooks, wherein the clamp member of the respective tong is movable relative to the annular seal.

19. The drill fluid collecting assembly of claim 18, wherein the annular seal is a one-piece annular seal member.

20. A method of collecting fluid in a space between a power tong and a backup tong, the method comprising:

creating a seal between a tubular string and the power tong using a first annular seal;

moving a clamp member of the power tong between a retracted position and a grip position while maintaining the seal between the tubular string and the power tong;

creating a seal between the tubular string and the backup tong using a second annular seal;

moving a clamp member of the backup tong between a retracted position and a grip position while maintaining the seal between the tubular string and the backup tong; and collecting fluid in the space between the power tong and the backup tong.

21. The method of claim 20, wherein each annular seal is a one-piece annular seal member.

* * * * *